United States Patent [19]

Maruyama

[11] 4,056,325

[45] Nov. 1, 1977

[54] MECHANICAL PENCIL

[76] Inventor: Tadaaki Maruyama, 1089-130 Nedo, Abiko, Chiba, Japan, 270-11

[21] Appl. No.: 673,884

[22] Filed: Apr. 5, 1976

[30] Foreign Application Priority Data

Apr. 7, 1975 Japan ..... 50-41191

[51] Int. Cl.[2] ..... B43K 21/16; B43K 21/00

[52] U.S. Cl. ..... 401/65; 401/82; 401/93; 401/6; 401/34

[58] Field of Search ..... 401/34, 6, 55, 56, 65–67, 401/82–90, 92–94

[56] References Cited

U.S. PATENT DOCUMENTS

| | | | |
|---|---|---|---|
| 1,062,274 | 5/1913 | Fischer | 401/82 X |
| 1,395,793 | 11/1921 | Broschart | 401/6 |
| 1,716,354 | 6/1929 | Nelson | 401/55 X |
| 2,385,442 | 9/1945 | Hoffman | 401/67 |
| 2,645,204 | 7/1953 | Bross | 401/55 X |
| 3,883,253 | 5/1975 | Naruse | 401/65 |

FOREIGN PATENT DOCUMENTS

| | | | |
|---|---|---|---|
| 1,319,055 | 1/1963 | France | 401/34 |

*Primary Examiner*—Stephen C. Pellegrino
*Attorney, Agent, or Firm*—Wenderoth, Lind & Ponack

[57] ABSTRACT

In a push-out type pencil, the lead thereof is extensible by longitudinally sliding the front portion of the pencil relative to the middle portion of the same, said sliding operation being effected in the writing position of hand by retracting said front portion between the extremities of the index and middle fingers to said middle portion clipped fast between the bases of the thumb and index finger adjacent to the web of hand and held stationary against the retracting movement of said front portion.

5 Claims, 20 Drawing Figures

E
B
R
F

MECHANICAL PENCIL

BACKGROUND OF THE INVENTION

The present invention relates to a novel method and apparatus for quickly extending the lead of a push-out type machanical pencil while held in the normal writing position in a hand. The method and apparatus result from the research of the basic operations of the hand, namely, the gripping and the unfolding operations thereof. More particularly, the method and apparatus are based on a discovery of the fact that the extremities of the index and middle fingers can clip the front portion of the pencil therebetween and drive it longitudinally in the writing postion of the hand, and in this manner, if the longitudinally relative movement is continued between the front portion and in the middle portion of the pencil for extending the lead, the extremities of the fingers can longitudinally retract the front portion of the pencil to the middle portion of the same in writing position in the hand when the middle portion of the pencil is clipped between the bases of the thumb and index finger adjacent the web of hand, and is thereby stationary against such retracting movement of the front portion. Hereinafter, the mechanical pencil of the present invention will be called a tip-knock type pencil.

DESCRIPTION OF THE PRIOR ART

In most conventional push-out type mechanical pencils, a push-button for extending the lead has been provided at the tail end of the pencil. In such a pencil, when an extension of the lead is required during the writing operation, the user must grip a middle portion of the pencil with four fingers except the thumb and then depress the push-button downwardly with the thumb. Such a pushing operation requires drastic changes of all fingers in their positions from the writing positions. This process takes much time and is very cumbersome for the user.

SUMMARY OF THE INVENTION

In view of the foregoing state of the prior art, it is an object of the present invention to provide a novel method and apparatus for quickly extending the lead of a push-out type mechanical pencil while maintaining the pencil in the normal writing position in the hand.

Briefly stated, the pencil in accordance with the present invention achieves the above objective by effecting the longitudinally relative movement required for the lead extending operation specifically between the front portion of the pencil and the middle portion of the same so as to be able to retract the front portion, which is clipped between the longitudinally movable extremities of the index and middle fingers in the writing position of the hand, to the middle portion, which is clipped between the bases of the thumb and index finger adjacent the web of the hand and is held stationary against the retracting movement of said front portion.

It is another object of the present invention to provide a longitudinally slidable means, such as a slider or a slidable pencil holder, in the middle portion of the pencil for effecting the longitudinally relative movement required for the lead extending operation.

It is another object of the present invention to provide friction means, such as a bulb, a rough surface or a vinyl chloride coating, in the front portion of the pencil for facilitating the clipping and retracting actions of the extremities of the index and middle fingers against the front portion.

It is still another object of the present invention to provide a lead stand at the bottom of the lead magazine of the pencil for aligning the lead, particularly thin lead, with the longitudinal axis of the pencil so as to quickly extend the lead from the magazine.

It is a further object of the present invention to provide a check hole at the side of the tip member of the pencil for inspecting the inside of the tip member without disassembling it from the pencil, and, if there are relatively large fragments of lead therein, for removing these lead fragments through the check hole directly.

It is still a further object of the present invention to provide a pencil adapter incorporated with the slider for assembling a double-tipped pencil in which each tip member provides a lead different in diameter or color.

It is a further object of the present invention to provide a concave Teflon seat at the bottom of the lead magazine for smoothly guiding the lead.

For a better understanding of the present invention, reference is made to the following brief description of the drawings.

DESCRIPTION OF THE PREFERRED EMBODIMENTS

Figures 1, 1A, 2, 3, 4:
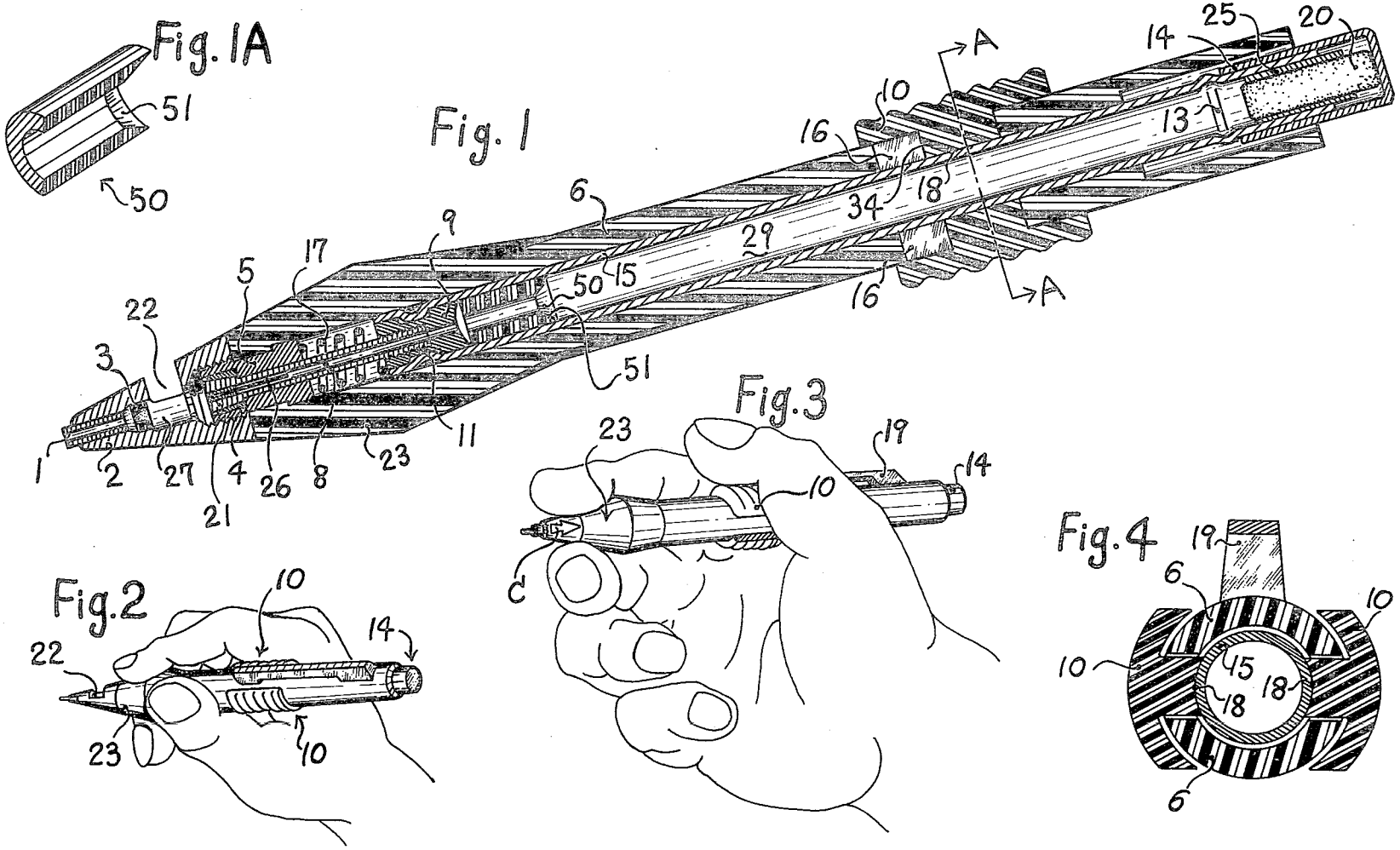
FIG. 1 is a longitudinal sectional view of the pencil according to one embodiment of the present invention and depicting the normal condition of the pencil.
FIG. 1A is a cutaway view in perspective showing the lead stand.
FIG. 2 is a perspective view of the pencil in writing operation.
FIG. 3 is a perspective view of the pencil in lead extending operation and depicting how the lead extending operation is performed.
FIG. 4 is a cross-sectional view taken along the line A—A of FIG. 1.

Referring now to the drawings for a detailed description of the present invention wherein like reference numerals identify like parts, FIG. 1 discloses a pencil of a novel tip-knock type in accordance with the present invention.

The pencil is characterized by the provisions of a pair of sliders 10, a bulb 23, a check hole 22, and a lead stand 50.

All of the other parts 1–6, 8, 9, 11, 13–15, 17, 19–21, 25–27 and 29 of the pencil, except the provisions of a pair of slots 16, are the same as a conventional push-out type mechanical pencil. Therefore, the pencil of the present invention can also extend the lead by depressing a cap or push-button 14 as in the case of the conventional type pencil.

As clearly shown in FIG. 1, the sliders 10 are diametrically opposite each other in the middle of the pencil, and are bonded at each of the innermost surfaces of their legs 34 to the outer periphery of an inner tube 15 through a pair of longitudinally elongated slots 16 which are disposed in the middle portion of an outer tube 6 to be diametrically opposite each other. These slots 16 receive the legs 34 of the sliders 10 slidably therein so as to allow the sliders 10 to slide longitudinally together with the inner tube 15 relative to the outer tube 6 by a predetermined distance required in lead extending operation. The bonded surface is shown by the reference numeral 18 in FIGS. 1 and 4. Due to the above construction of the pencil, when the cap 14 is depressed downward, the pair of sliders 10 are moved forwardly, and vice-versa.

The bulb 23 is integrally formed with the front portion of the outer tube 6 so as to apply a retracting force to the outer tube 6 by using the extremities of the index and middle fingers when the lead extension is required. As shown in FIG. 3, the bulb 23 can be clipped between the fingers in the writing position in the hand. Also, the bulb 23 can be retracted in the direction of arrow C relative to the sliders 10 which are clipped between the bases of the thumb and index finger adjacent the web of the hand and is held stationary against the retracting movement of the outer tube 6. When the outer tube 6 is thus retracted, as shown in FIG. 3, the longitudinally relative movement required for the lead extending operation is produced between the outer tube 6 and the inner tube 15 as in the case of the conventional type pencil.

As shown in FIGS. 1 and 2, a tip member 2 of the pencil is provided with the check hole 22 at its side for inspecting the inside 27 of the tip member 2 to determine whether or not the lead is properly chucked by a collect chuck 21. The check hole 22 also serves as a bypath hole 22 for removing fragments of lead therethrough. Such fragments of lead are generally produced in the lead magazine 29 of the pencil and tend to accumulate in the inside 27 of the tip member 2 due to the existence of the throttle pass of a resilient lead gripping sleeve 3 which is generally made of neoprene or polyurethane. When the throttle pass of the sleeve 3 is blocked by the fragments of lead, the pencil functions improperly, because such fragments prevent the lead from being gripped by the sleeve 3 in the initial lead gripping operation. In a conventional type pencil, due to the lack of such a check hole 22 of the present invention, these fragments of lead must be removed from the inside 27 of the tip member 2 by disassembling the tip member 2 from the pencil. However, this disassembly of the tip member 2 takes much time and is troublesome. In contrast with such a conventional type pencil, in the pencil of the present invention, the fragments of lead can be removed directly from the inside 27 of the tip member 2 through the check hole 22 without disassembling the tip member 2 from the pencil.

As shown in FIGS. 1 and 1A, a lead stand 50 having a cylindrical shape is disposed at the bottom of the lead magazine 29 and is held integrally with the magazine 29 by press-fitting therewith. At the rear of the stand 50 is a conically enlarged bore 51 which serves to guide the lead into the stand 50 and align the lead with the axis of a collet tube 8 which connects threadably with a collet carrier 9. In a conventional type pencil, due to the lack of such a stand 50, the lead tends to fall into the magazine 29, and it is hard to align the lead, particularly thin lead, with the axis of the collet tube 8 when the lead magazine 29 has a large capacity.

In contrast with such a conventional type pencil, the pencil of the present invention can always align the lead with the axis of the collet tube 8, even if the thin lead is used with the large capacity magazine 29.

Referring now to the conventional construction of the pencil shown in FIG. 1, the lead is finally guided by a thin pipe 1 which is generally press-fitted in the front projection of the tip member 2. At the front portion of the collet tube 8 is the collet chuck 21 whose diameter is controlled by slidably engaging with a clamp ring 4 which is slidably received in a tip mount 5. The collet chuck 21 is generally provided with three longitudinal cuttings 26 equally spaced to each other for making its diameter variable. A compression spring 17 is disposed between the tip mount 5 and the collet carrier 9, and thereby upwardly biases the inner tube 15 whose front end connects fixedly with the collet carrier 9 through a ring stake 11. The entrance to the lead magazine 29 is closed by an eraser 20 encircled with a metallic sleeve 25, and is covered by the cap 14 whose front end abuts on a bead 13 formed at the rear portion of the inner tube 15 so as to prevent the cap 14 depressing the eraser 20 excessively into the magazine 29. A slip 19 is attached to the rear portion of the outer tube 6 as shown in FIG. 3.

The above-described pencil will operate as follows.

By exerting axial pressure onto the cap 14 or sliding the sliders 10 forwardly relative to the outer tube 6, the inner tube 15, the collet carrier 9, the collet tube 8, and the collet chuck 21 are moved against the force of the spring 17 toward the resilient lead gripping sleeve 3. During such movement the clamp ring 4 is taken along until the front end thereof engages the rear end opening edge of the inside 27 of the tip member 2, and thereby the lead is maintained in its chucked condition to project a new section of the lead which will pass forcibly through the sleeve 3 against its frictional resistance.

During further movement of the collet chuck 21, the outer conical face thereof will become axially displaced from the inner conical face of the clamp ring 4 so that the chuck 21 will open and release the lead, and thereafter the chuck 21 will abut with its end face against the rear end face of the sleeve 3 for terminating its forward movement. When there is no lead in the collet tube 8 in this operation, a new lead will drop to the sleeve 3 from the magazine 29 through the collet tube 8.

After the cap is released, the chuck 21 is returned by the action of the spring 17 to its original position shown in FIG. 1, while on the other hand, the lead remains in its advanced position due to the frictional engagement with the sleeve 3. Thus, the chuck 21 engages with its outer conical face the inner conical face of the clamp ring 4 and moves the latter likewise until the rear end of the clamp ring 4 engages the bottom of the enlarged front bore of the tip mount 5.

Subsequently thereto, the outer conical face of the chuck 21 is pressed against the inner conical face of the clamp ring 4 under the action of the spring 17 so that the chuck 21 clamps and holds the lead. Each time operating pressure is applied to the cap 14 or the sliders 10, the chuck 21 drives the lead forwardly through the sleeve 3, and then leaves the lead in its advanced position for obtaining the necessary extension of the lead.

Since the sliders 10 of the above-mentioned embodiment in FIGS. 1–4 always move together with the cap 14, the pencil of such embodiment is not necessarily adequate for extending the lead in the same manner as a conventional push-out type pencil in which the middle portion of the pencil where the sliders 10 are disposed must be gripped with four fingers except the thumb against the depressing force applied to the cap 14 by the thumb.

Figures 5, 6, 7, 8, 9, 10:
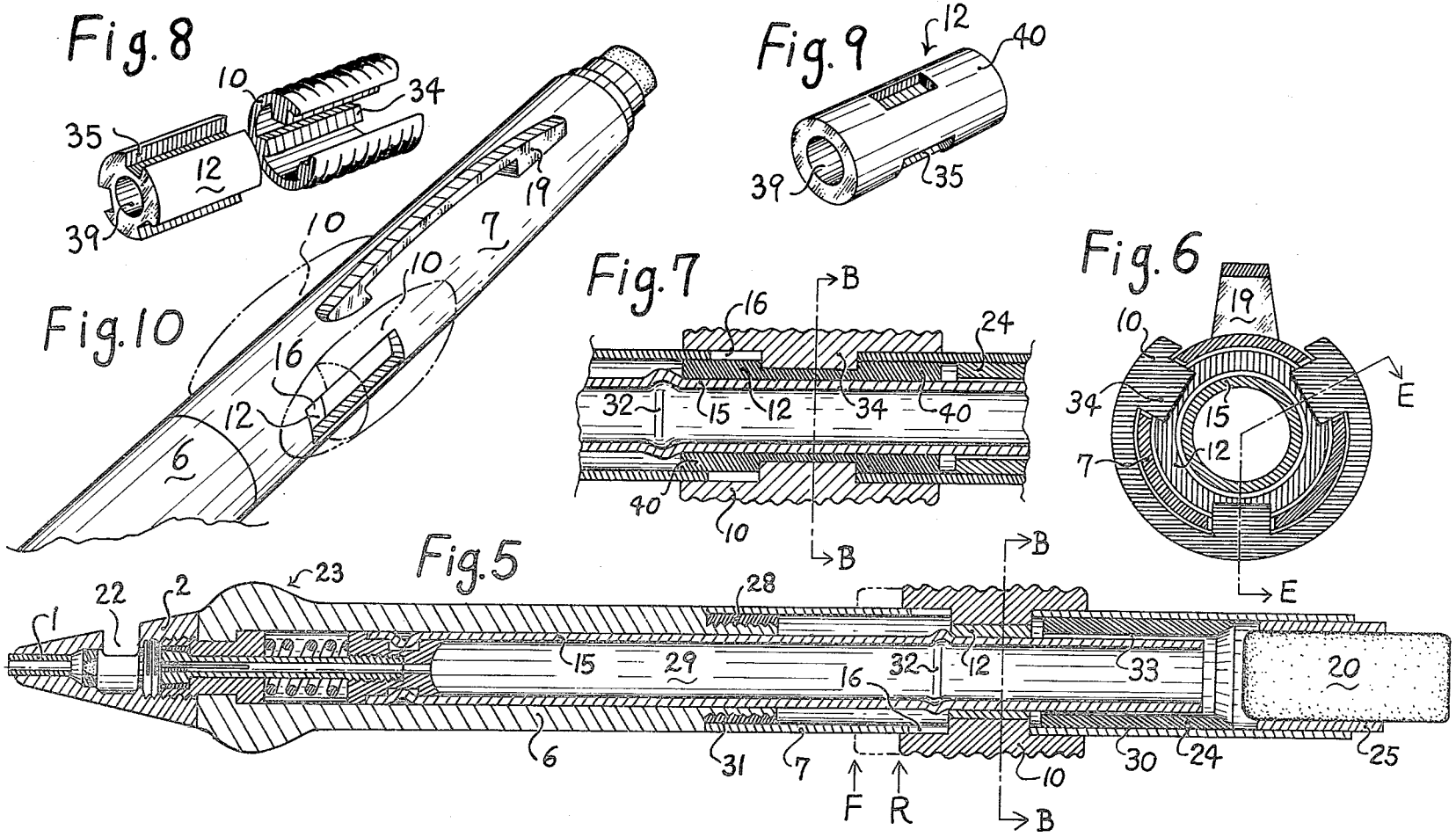
FIG. 5 is a longitudinal sectional view of the pencil according to another embodiment of the present invention and depicting in phantom line the forwardly slided position of the slider.
FIG. 6 is a cross-sectional view taken along the line B—B of FIGS. 5 and 7.
FIG. 7 is a partial longitudinal sectional view taken along the line E—E of FIG. 6 and depicting the pencil according to still another embodiment of the present invention.
FIG. 8 is a disassembled view in perspective showing the slider assembly comprising the slider and the sliding sleeve.
FIG. 9 is a perspective view of the sliding sleeve according to another embodiment of the present invention.
FIG. 10 is a fragmentary view in perspective showing in phantom line the slider according to still another embodiment of the present invention.

For overcoming the above-mentioned point, another embodiment of the sliders is disclosed in FIGS. 5–10. One of the sliders 10 of this embodiment is bonded to a sliding sleeve 12 with a suitable adhesive such as epoxy resin as shown in FIG. 5. In this construction, only the forward sliding movement of the sleeve 12 relative to the inner tube 15 is prevented by the provision of a bead 32 formed at the middle portion of the inner tube 15. Therefore, if such a construction consisting of the bead 32, the sleeve 12 and the slider 10 is applied to the corresponding parts of the pencil of FIGS. 1–4, the above-mentioned problem may be resolved, because the slider 10 may be held stationary together with the depression of the inner tube 15 caused by the thumb depressing the cap 14 during the conventional lead extending operation.

Another difference in construction between the pencils of FIGS. 1 and 5 resides in the construction of the outer tube 6. As shown in FIG. 5, the outer tube 6 of FIG. 1 is divided into an outer tube 6 having a male screw portion at its rear end and a pencil holder 7 having a plurality of slots 16 in the embodiment of FIG. 5. The pencil holder 7 connects threadably with the outer tube 6 through the nut 28 which is bonded or press-fitted to the front end 31 of the holder 7. The rear portion of the inner tube 15 is slidably guided by a guide tube 24 which is press-fitted in the rear portion 30 of the holder 7. The sliding gap is shown by reference numeral 33. As shown in FIG. 5, the pencil of this embodiment is not provided with a push-button or cap, and thereby obtains the benefit for directly using the eraser 20. The slider 10 is reciprocated between the forward position F, which is shown in phantom line in FIG. 5, and the rearward position R in solid line for extending the lead in the same manner as the previous embodiment of FIG. 3. The other embodiments of the sliding sleeve 12 are shown in FIGS. 8 and 9. In the embodiment of FIG. 8, the sleeve 12 has three longitudinal full-length grooves 35 equally spaced in addition to the provision of a center bore 39 in which the rear portion of the inner tube 15 is slidably inserted, as shown in FIG. 5. In the grooves 35, the corresponding legs 34 of the slider 10 are inserted and bonded thereto with a suitable adhesive. For eliminating such bonding operation, in FIG. 9, the grooves 35 are shortened to form a pair of flanges 40 at its front and rear portions. By providing such flanges 40, as shown in FIG. 7, the slider 10 may drive the sliding sleeve 12 forwardly without slipping. In this case, it is desirable to press-fit the legs 34 of the slider 10 into the shortened grooves 35 of the sleeve 12. Since the cross-section of the slider 10 is a snapping-like configuration, as shown in FIG. 6, the slider 10 has a self-retaining function to the sliding sleeve 12, even if the adhesive is omitted.

Figure 14:
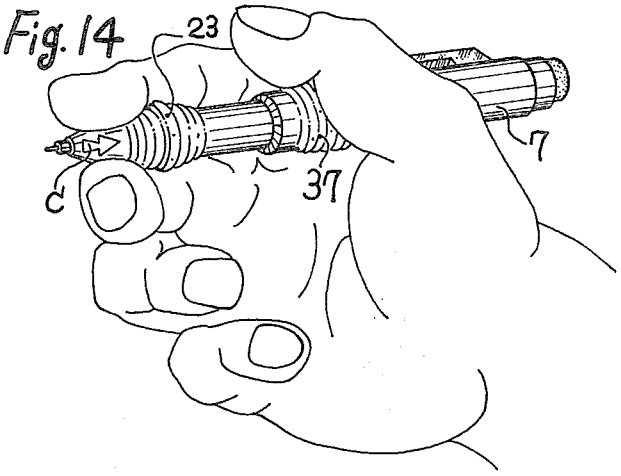
FIG. 14 is a perspective view of the pencil of FIG. 11 and depicts how the lead extending operation is performed.
Figure 11:
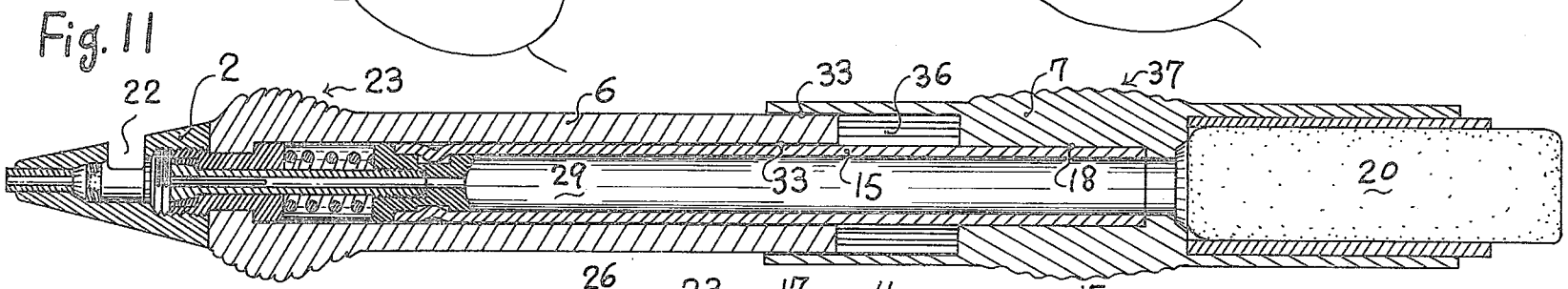
FIG. 11 is a longitudinal sectional view of the pencil according to a further embodiment of the present invention.

Another embodiment of the tip-knock type pencil of the present invention is shown in FIGS. 11 and 14. In the pencil of this embodiment, an elongated pencil holder 7 provided with a rough surface 37 at its outer periphery for facilitating its grip required in the tip-knock operation serves as the slider 10 in the previous embodiments. For preventing the holder 7 from rotating relative to an outer tube 6, the holder 7 is provided with a splined front inner wall 36, which is slidably guided along the longitudinal axis of the pencil by the splined rear periphery of the outer tube 6 through the sliding gap 33. The rear portion of the inner tube 15 is press-fitted or bonded through the surface 18 to the center bore of the holder 7. The middle and the front portions of the inner tube 15 are slidably guided by the outer tube 6 through the sliding gap 33. It is desirable to provide a rough surface on the bulb 23 of the outer tube 6. It is further desirable to coat the bulb 23 with a suitable resilient material, such as vinyl chloride, neoprene, polyurethane, or fabric. In this embodiment of FIGS. 11 and 14, the tip-knock operation of the present invention is effected in the same manner as the previous embodiment of FIG. 3, as shown in FIG. 14.

Figure 13:
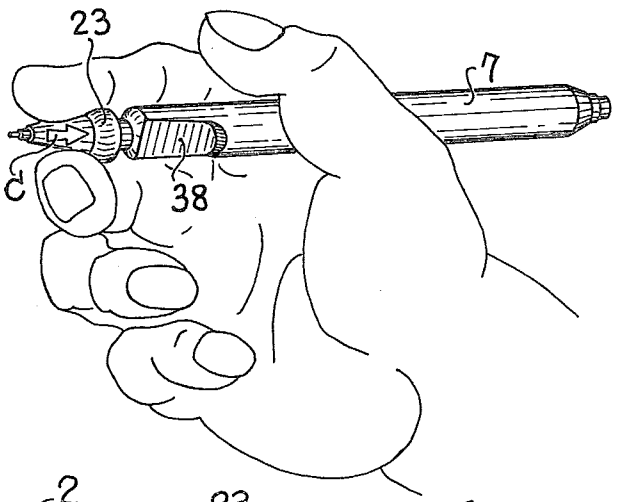
FIG. 13 is a perspective view of the pencil of FIG. 12 and depicting how the lead extending operation is performed.
Figure 12:
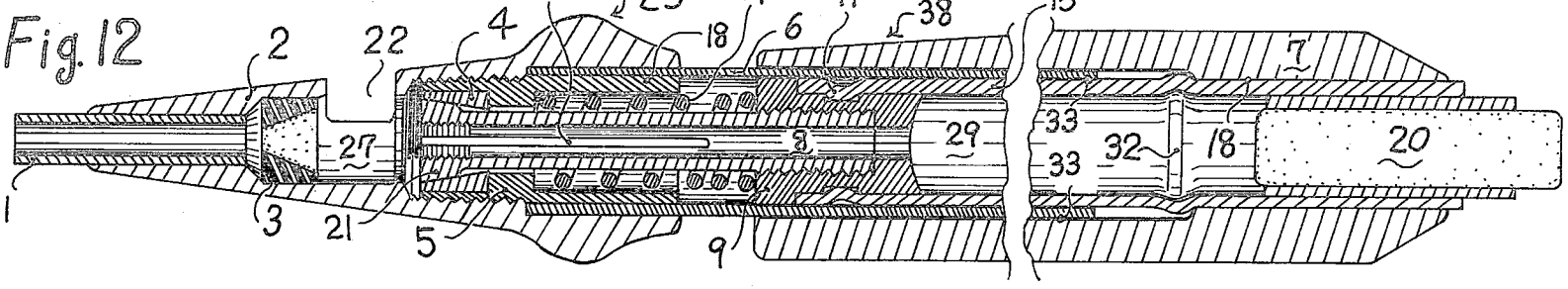
FIG. 12 is a longitudinal sectional view of the pencil according to yet a further embodiment of the present invention.

Another embodiment of the tip-knock type pencil of the present invention is shown in FIGS. 12 and 13. In the pencil of this embodiment, the bulb 23 is integrally formed with the rear portion of the tip member 2, and the front end of the outer tube 6 is press-fitted or bonded between the tip mount 5 and the tip member 2. Another difference in construction between this and the previous embodiments resides in the construction of a further elongated pencil holder 7 provided with a finger mount 38 at its front portion. By further elongating the holder 7, it becomes possible to effect the tip-knock operation comfortably without worrying about the difference in hand size, for example, between children and men. In the pencil of this embodiment, it is necessary to coat the outer periphery with a suitable frictional material, such as vinyl chloride, for ensuring a secure grip. As shown in FIG. 13, the tip-knock operation of this embodiment is effected in the same manner as the previous embodiment of FIGS. 3 and 14.

Figures 15, 16, 17, 18, 19:
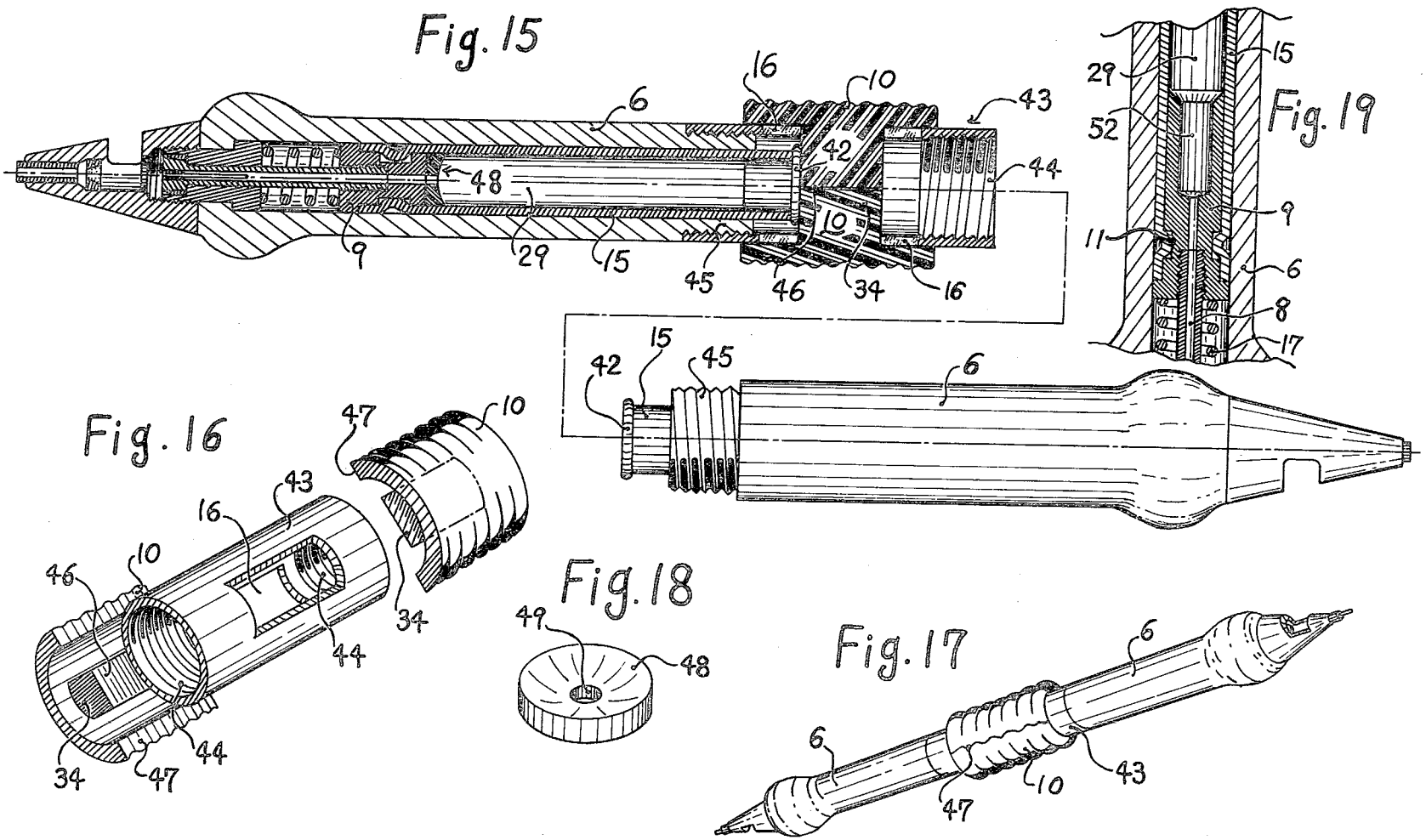
FIG. 15 is a disassembled view in longitudinal sectional showing a double-tipped pencil according to an additional embodiment of the present invention.
FIG. 16 is a disassembled view in perspective showing the pencil adapter assembly comprising the slider and the pencil adapter.
FIG. 17 is a perspective view of the assembled double-tipped pencil of FIG. 15.
FIG. 18 is a perspective view of the concave Teflon seat employed in the pencil of FIG. 15.
FIG. 19 is a fragmentary, longitudinal sectional view showing the lead stand integral with the collect carrier.

Still another embodiment of the tip-knock type pencil of the present invention is shown in FIGS. 15–17. The purpose of this embodiment is to provide a double-tipped pencil in which each tip member provides the lead different in diameter or color. The pencil of this embodiment consists of a pair of push-out type pencils aligned in the opposite directions and connected to each other back-to-back through a pencil adapter 43 incorporating with the slider 10 as shown in FIG. 15. The adapter 43 having a cylindrical shape is provided with a pair of female screws 44 at both its forward and rearward openings, and a pair of slots 16, the longitudinal length of which are further elongated so as to allow the slider 10 to move in both forward and rearward directions from its neutral position shown in FIG. 15 during the tip-knock operation. At the rear end of the outer tube 6 of the pencil is a male screw 45 which threadably connects with one of the female screws 44 of the adapter 43 so as to make a cap 42 covering the rear end of the inner tube 15 abut against one side of the leg 34 of the slider 10 which consists of two pieces bonded to each other at the innermost surfaces 46 of the legs 34 and a pair of outer periphery cutting surfaces 47 of the slider 10. When the pencil is assembled as shown in FIG. 17, the slider 10 is held in its neutral position by being clipped at its leg 34 with the caps 42 of both side pencils.

Since the double-tipped pencil is thus constructed, the tip-knock operation of the present invention may be effected on both tip members in the same manner as the previous embodiments shown in FIGS. 3, 13 and 14.

At the bottom of the lead magazine 29 is a concave Teflon seat 48 having a center hole 49 for smoothly passing the lead. FIG. 19 shows another embodiment of the lead stand 50 shown in FIGS. 1 and 1A. In the embodiment of FIG. 19, the lead stand is integrally formed with the collet carrier 9, and thereby forms a lead stand bore 52 at the rear portion of the carrier 9.

While the present invention has been described with reference to specific embodiments thereof, it should be understood that various other embodiments and modifications, all within the true spirit and scope of the present invention, may be developed by those skilled in the art.

What is claimed is:

1. A push-out type mechanical lead pencil comprising:

an outer tube means for forming a pencil body;

a bulb at the lower end of said outer tube means where a writer's fingers are positioned while writing;

a hollow tip mount at the forward end of said outer tube means and extending therefrom, the forward threaded;

a hollow tip member threaded onto the forward end of said tip mount;

a collet chuck means expandable within and extending rearward from said hollow tip for holding lead therein;

an inner tube means longitudinally moveable coaxially within said outer tube means for holding lead therein and for forcing against said collet chuck;

push button means at the end of said inner tube means extending outside said outer tube means for moving said inner tube means;

said outer tube means further having at least one longitudinal slot therein parallel to the axis of said tube at the portion of said outer tube means where the web of the writer's thumb and index finger contact said outer tube means; and a slider at least partially circumferentially surrounding and slidable along said outer tube member, said slider being fitted through said slot in said outer tube means and contacting said inner tube means.

2. A push type pencil as claimed in claim 1 wherein said slider is directly secured to said inner tube means through said slot in said outer tube means.

3. A push type pencil as claimed in claim 1, wherein said inner tube means has a bead formed around the outside circumference thereof forward of said slot through said outer tube means surrounding said inner tube means; and further comprising a sliding sleeve coaxially and slidably mounted on said inner tube means and abutting at the front end thereof said bead, whereby forward movement of said slider is transmitted against said bead.

4. A push type pencil as claimed in claim 3 wherein said slider is snap-fitted to said sliding sleeve through said slots in said outer tube means.

5. A push type pencil as claimed in claim 4 wherein said sliding sleeve further has flanges at each end thereof abutting against said slider for preventing said slider from slipping out of said sleeve when said slider and sleeve are pushed against said bead.

* * * * *